United States Patent [19]

Komatsu et al.

[11] Patent Number: 4,621,463

[45] Date of Patent: Nov. 11, 1986

[54] METHOD OF GRINDING CAMS ON A CAMSHAFT

[75] Inventors: Yuichiro Komatsu; Toshio Maruyama, both of Kariya, Japan

[73] Assignee: Toyoda Koki Kabushiki Kaisha, Kariya, Japan

[21] Appl. No.: 661,684

[22] Filed: Oct. 17, 1984

[30] Foreign Application Priority Data

Oct. 20, 1983 [JP] Japan ..... 58-196626

[51] Int. Cl.[4] ..... B24B 1/00

[52] U.S. Cl. ..... 51/281 C; 51/327

[58] Field of Search ..... 51/281 C, 289 R, 105 SP, 51/105 EC, 101 R, 165.77, 165.79, 165.89, 326

[56] References Cited

U.S. PATENT DOCUMENTS

| | | | |
|---|---|---|---|
| 4,019,288 | 4/1977 | Moritomo | 51/327 |
| 4,094,105 | 6/1978 | Hatanaka et al. | 51/101 R |
| 4,118,900 | 10/1978 | Moritomo | 51/327 |
| 4,299,061 | 11/1981 | Parnum | 51/101 R |
| 4,528,781 | 7/1985 | Koide et al. | 51/281 C |

*Primary Examiner*—Frederick R. Schmidt

*Assistant Examiner*—Robert A. Rose

*Attorney, Agent, or Firm*—Oblon, Fisher, Spivak, McClelland & Maier

[57] ABSTRACT

A method of successively grinding a plurality of cams on a camshaft by performing a grinding cycle for each of the cams after each cam is brought into alignment with a grinding wheel through indexing movement in the axial direction thereof. The grinding cycle is performed with said camshaft being rotated and rocked respectively about its axis and a pivot axis parallel thereto and includes first to fourth steps. The substantial part of a stock removal of each cam is removed in the first step wherein the grinding wheel is infed at a rapid infeed rate as the camshaft is rotated at a slow rotational speed. The camshaft is rotated at a high rotational speed in the second step for removing from the cam a part of the stock removal which is to be cut off, but left uncut in the first step. Rotation of the camshaft at the high rotational speed is continued while the grinding wheel is infed in the third step for removing a grinding crack layer from the cam. Finally, the fourth step is carried out, wherein for finish grinding, the grinding wheel is infed against the cam rotating at a slow rotational speed.

9 Claims, 6 Drawing Figures

METHOD OF GRINDING CAMS ON A CAMSHAFT

BACKGROUND OF THE INVENTION

1. Field of the Invention

The present invention relates to a method of successively grinding a plurality of cams on a camshaft which, while being rotated about its axis, is rocked about a pivot axis parallel to the camshaft axis in such a manner as to follow one of master cams which is allocated to one of the cams in alignment with a grinding wheel.

2. Description of the Prior Art

Generally, in cam profile grinding, each cam on a camshaft is ground with the camshaft being rotated and being rocked following one of master cams allocated thereto. Once the camshaft is set up on a chucking device of a cam grinder, any of the cams is automatically subjected first to a rough grinding and then to a finish grinding.

As a known cam grinding method of this kind, there has been used a so-called two-series step grinding method for successively grinding all of the cams of a camshaft. In each of first series steps, a rough grinding cycle using a grinding wheel roughly dressed is performed on each cam after the same is aligned with the grinding wheel through axial indexing movement of the camshaft. The first series steps are followed by second series steps, in each of which a finish grinding cycle using the grinding wheel finely dressed is performed on each cam after the same is aligned with the grinding wheel through axial indexing movement of the camshaft.

In this known method, since a dressing is effected on the grinding wheel in advance of the second series steps, the grinding efficiency in each rough grinding step may be heightened at the cost of the damage which is caused on the grinding wheel in the first or rough grinding series steps. However, the known method requires one to repeat twice a series of the axial indexing movements which corresponds in number to the cams of the camshaft. This disadvantageously causes a long period of time to be taken for such axial indexing movements of the camshaft, thereby making it difficult to shorten the total cycle time required for each camshaft.

In order to shorten the total cycle time, it is effective to perform rough and finish grinding steps successively on each cam so that all of cams on a camshaft can be finished through one series of indexing movements of the camshaft. In this case, how to diminish the damage which is caused on the grinding wheel in the rough grinding step is the key point to improvements in the surface roughness and the profile accuracy of each cam.

SUMMARY OF THE INVENTION

Accordingly, it is a primary object of the present invention to provide an improved cam grinding method capable of finishing all of cams on a camshaft through one series of axial indexing movements of the camshaft which correspond in number to the cams on the camshaft, thereby shortening the total cycle time required for the camshaft.

Another object of the present invention is to provide an improved cam grinding method of the character set forth above wherein the damage on a grinding wheel in each rough grinding step is caused as small as possible so that the finish accuracy of each cam can be heightened notwithstanding that no dressing is performed on the grinding wheel between rough and finish grindings for the cam.

Briefly, according to the present invention, there is provided a cam grinding method of successively grinding a plurality of cams on a camshaft with a rotating grinding wheel. The method comprises first through fourth steps which are sequentially carried out with the camshaft being rotated and rocked respectively about its axis and a pivot axis parallel thereto, for finishing each of the cams selectively aligned with the grinding wheel. A rough grinding is effected in the first step, wherein a substantial part of a removal amount of the aligned cam is removed by infeeding the grinding wheel at a rapid infeed rate while the camshaft is rotated at a slow rotational speed. In the second step, the rotational speed of the camshaft is increased to a high rotational speed for removing from the aligned cam a part of the removal amount which is to be cut off, but left uncut in the first step. In the third step, the camshaft is rotated at a high rotational speed, while the grinding wheel is infed for removing a grinding crack layer from the aligned cam. A finish grinding is effected in the fourth step, wherein the grinding wheel is infed with the camshaft being rotated at a slow rotational speed. The method further comprise a fifth step, in which the camshaft is axially indexed for bringing another cam into alignment with the grinding wheel, so that said another cam is subsequently ground by sequentially performing the first to fourth steps.

According to this grinding method, the rough to finish grindings are successively effected on each cam of the camshaft when the same is in a given axial indexing position. This makes it possible to decrease the number of indexing movements of the camshaft which are required to finish all of the cams of the camshaft, whereby the total cycle time for the camshaft can be remarkably shortened. Moreover, the provision of the second and third steps between the first and fourth steps makes it possible not only to efficiently remove the substantial part of the removal amount from each cam in the first step, but also to precisely finish each cam in the fourth step notwithstanding that no dressing is effected on the grinding wheel in the mid course of the first though fourth steps.

In another aspect of the present invention, the rotational speed of the camshaft in each of the second and third steps is chosen to be faster than that in each of the first and fourth steps. Therefore, a part of the removal amount which is to be cut off, but left uncut in the first step can be reliably removed in the second step, and in the third step, a small infeed amount of the grinding wheel is sufficient to perfectly remove any grinding crack layer which may be created on each cam in the first step.

BRIEF DESCRIPTION OF THE ACCOMPANYING DRAWINGS

The foregoing and other objects, features and the attendant advantages of the present invention will be readily appreciated as the same becomes better understood by reference to the following detailed description of preferred embodiments when considered in connection with the accompanying drawings, wherein like reference numerals designate identical or corresponding parts throughout the several views, and in which.

DETAILED DESCRIPTION OF THE PREFERRED EMBODIMENTS

Figure 1:
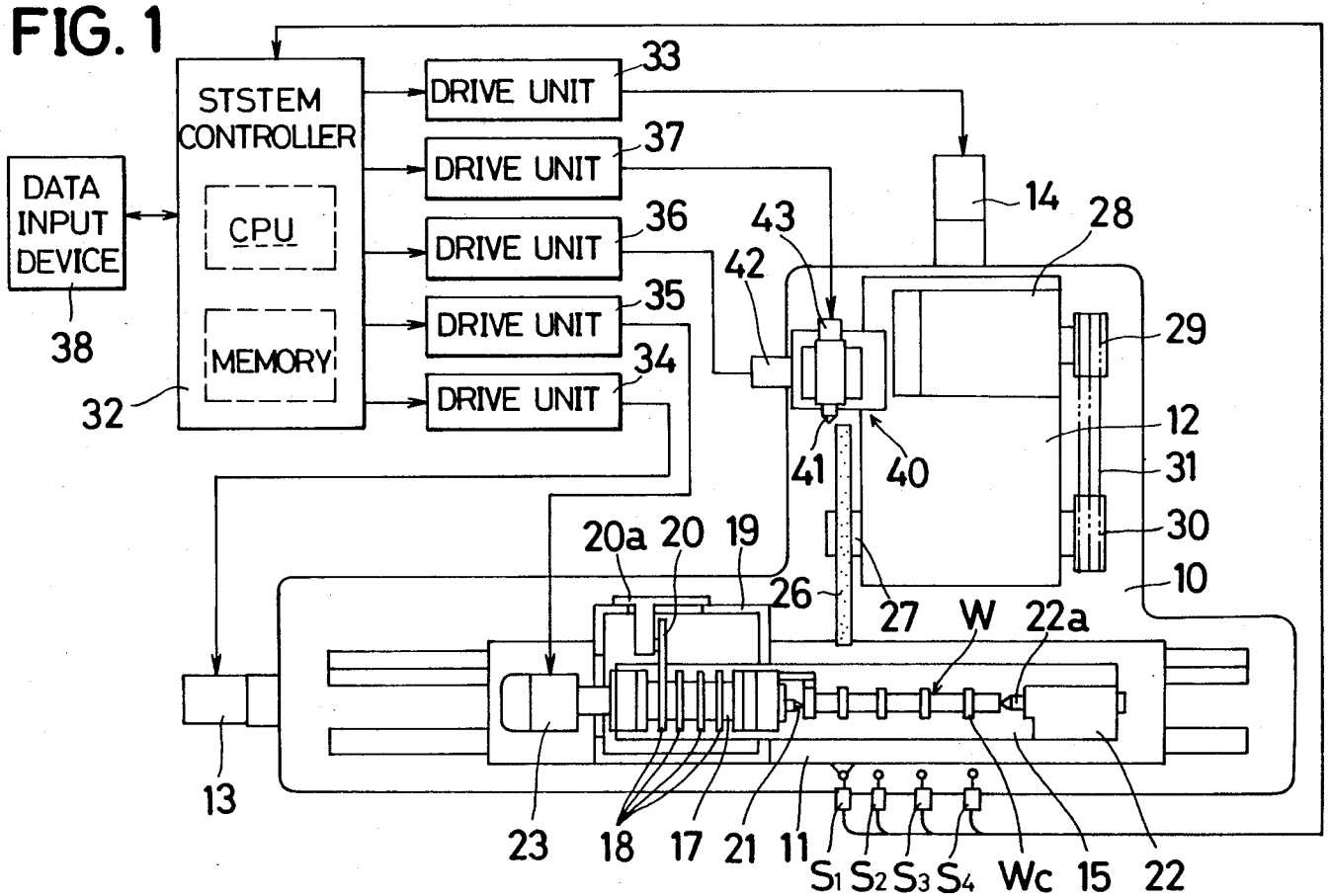
FIG. 1 is a general plan view, partly in section, of a cam grinder which practices a cam grinding method according to the present invention.
Figure 2:
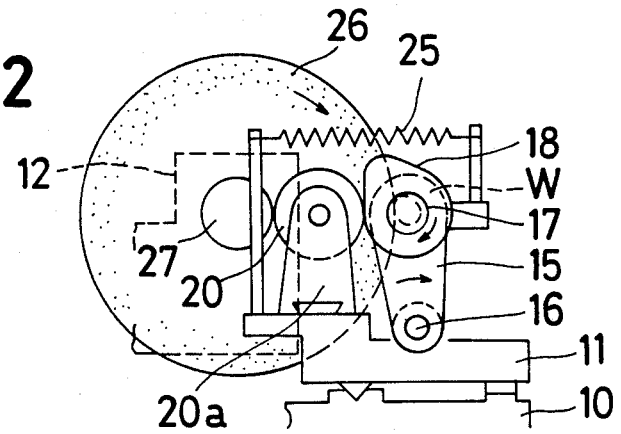
FIG. 2 is a schematic elevational view illustrative of a cam profiling mechanism incorporated in the cam grinder.

Referring now the the drawings and particularly to FIGS. 1 and 2 thereof, the body of a cam grinder is composed of a bed 10, on which a work table 11 and a wheel head 12 are guided to be slidable in respective directions perpendicular to each other. Movements of the table 11 and the head 12 are controlled by a variable speed motor 13 and a stepping motor 14, respectively. A rocking table 15 is carried on the work table 11 for pivot or rocking motion about a pivot shaft 16. A work spindle 17 extending parallel to the pivot shaft 16 is rotatably carried at one end portion of the rocking table 15. A plurality of master cams 18 are secured to the mid portion of the work spindle 17 and is selectively brought by the tension force of a spring 25 into contact with a follower roller 20, which is rotatably carried by a roller support 20*a*. The roller support 20*a* is indexably carried on a workhead 19 fixed on the work table 11 for bringing the follower roller 20 into selective contact with the master cams 18. Thus, rocking motion depending upon the profile of one of the master cams 18 which is in contact with the follower roller 20 is imparted to the rocking table 15 upon rotation of the work spindle 17.

The work spindle 17 holds at its inner end a center 21, which is co-axially opposite to a center 22*a* of a tailstock 22 fixed at the other end portion of the rocking table 15. These centers 21 and 22*a* cooperate with each other to rotatably support a camshaft W having a plurality of cams Wc to be ground. Fixed on the work table 11 is a servomotor 23, which is drivingly connected to the work spindle 17 on the rocking table 15 so as to rotate the work spindle 17. Preferably, an output shaft (not shown) of the servomotor 23 is in axial alignment with the pivot shaft 16, so that rotation of the servomotor 23 is correctly transmitted to the work spindle 17 through a conventional pulley-belt mechanism (not shown) while the rocking table 15 is pivotally moved about the pivot shaft 16.

The wheel head 12 rotatably carries a wheel spindle 27, to one end of which a grinding wheel 26 is secured. A wheel motor 28 mounted on the wheel head 12 is in driving connection with the wheel spindle 27 through a pair of pulleys 29 and 30 and a set of belts 31. A dressing apparatus 40 is also mounted on the wheel head 12 for dressing the grinding wheel 26. The dressing apparatus 40 has a dressing tool 41, which is movable by a motor 42 in a direction parallel to the axis of the wheel spindle 27. The dressing tool 41 is intermittently infed by a stepping motor 43 against the grinding wheel 26 in another direction transverse to the axis of the wheel spindle 27.

Indicated at 32 is a system controller, which incorporates a central processing unit CPU and a memory therein for controlling various components of the above-described cam grinder in accordance with programmed command data stored in the memory. The wheel infeed stepping motor 14, the table traverse variable speed motor 13, the spindle drive servomotor 23, the dresser traverse motor 42 and the dresser infeed stepping motor 43 are connected to the system controller 32 respectively through drive units 33, 34, 35, 36 and 37. Thus, step infeed of the wheel head 12, low-high speed changeover of the work spindle 17, table indxing for selective alignment of the grinding wheel 26 with one of cams Wc and dressing of the grinding wheel 26 are controlled in accordance with control commands issued from the system controller 32, as referred to later. Limit switches S1–S4 are further provided for respectively confirming four indexing positions taken by the work table 11. Confirmation signals from these switches S1–S4 are input to the system controller 32 to discontinue rotation of the table traverse variable speed motor 13 at respective indexing positions.

The system controller 32 is provided with a data input device 38 connected thereto, which enables an operator to input control commands so that a grinding cycle according to the present invention can be executed by the cam grinder, as described later. Various grinding conditions, including wheel infeed rates, wheel infeed amounts, work spindle rotational speeds, table indexing amounts etc., are in turn input by the input device 38 for storage in the memory.

Figure 3:
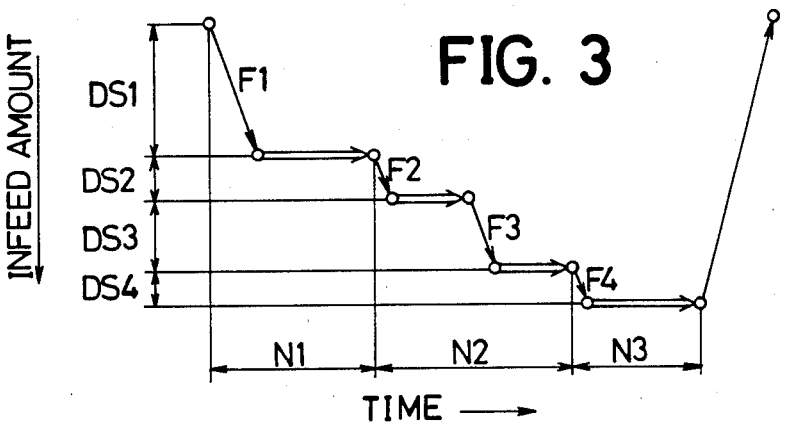
FIG. 3 is a chart showing a cam grinding cycle according to the present invention.

A grinding cycle in which the cam grinder operates will be described hereafter with reference to FIG. 3.

The grinding cycle is contemplated for successively effecting rough and finish grindings on each of cams Wc of the camshaft W. In principle, the grinding cycle comprises four grinding steps: first step for efficiently performing a rough grinding in such a manner that the most part of a stock removal which each cam Wc has is removed without causing a large damage on the grinding wheel 26, second step for removing stocks which are left uncut respectively at side portions of each cam Wc in the first step, third step for removing a thermally affected layer with grinding cracks which is created in the first step, and fourth step for performing a finish grinding in such a manner as to improve the surface roughness and the profile accuracy of each cam Wc.

More specifically, in the first step, the rough grinding of each cam Wc is carried out in such a manner that the wheel head 12 is infed as large an infeed amount DS1 as, for example, 2.2 mm (millimeters) at a high infeed rate F1 as the work spindle 17 is rotated at a low speed N1. In this case, the work spindle rotational speed N1 is set to 15 rpm, for example, which is the lowest of the work spindle rotational speeds in the grinding cycle. The infeed rate F1 is set to 90 mm/min so that the wheel head 12 reaches the rough infeed end before one rotation of the cam Wc is completed. The spark-out grinding time is set to the time which is taken to rotate the cam Wc one or two rotations. Where the rotational speed of the work spindle 17 is low like this, the variation in the material removal rate is small, and the area of contact between the cam Wc and the grinding wheel 26 is increased, thereby reducing the load acting on each abrasive particle. Accordingly, the damage on the grinding wheel 26 can be diminished notwithstanding such an increase in the infeed rate of the wheel head 12.

In the second step, in order to prevent grinding cracks from being created due to stocks which are left uncut at side portions of the cam Wc, the work spindle 17 is rotated at a high speed N2, and the wheel infeed amount DS2 is set as small as, for example, 0.05 mm lest the grinding crack layers should increase at the uncut stock portions. For example, the work spindle rotational speed N2 is set to 60 rpm which is the fastest in the grinding cycle, and the infeed rate F2 is set to 60 mm/min. The spark-out grinding time in this case is chosen to the time which is taken for the cam Wc to rotate one or two rotations.

In the third step, the rotational speed of the work spindle 17 is maintained at the high speed N2. However, because the work spindle rotation at such a high speed tends to give the grinding wheel 26 a large damage, the infeed amount DS3 is chosen to a value which is not relatively large, but is required to remove the grinding crack layer created in the first step, namely to 0.2 mm or so, for example. The work spindle rotational speed N2 and the infeed rate F3 in this step are the same as those in the second step, and the spark-out grinding time is chosen to the time which is taken to rotate the cam Wc one or two rotations.

As noted from the above, in the second and third steps, the uncut stocks left at the side portions of the cam Wc in the first step are removed to correct the profile of the cam Wc, and thereafter, the grinding crack layer is removed. Consequently, the stock removal at each side portion of the cam Wc is not increased in the third step, and this results in preventing any new grinding crack layer from being created in each side portion of the cam Wc.

In the foruth step which is carried out to form a desired finish surface on the cam Wc, the infeed amount DS4 is set to be the smallest (e.g., 0.01 mm) of those in the grinding cycle, and the rotational speed of the work spindle 17 is chosen to a low speed N3 which is so low as to obtain a desired surface roughness. For example, the work spindle rotational speed N3 and the infeed rate F4 are chosen to 27 rpm and 30 mm/min, respectively. The spark-out grinding time is set to permit two rotations of the cam Wc therewithin.

As is clear from the foregoing, the work spindle rotational speeds N1–N3 in the four steps are determined to have a relation N2>N3>N1, and the infeed amounts DS1–DS4 are determined to have a relation DS1>DS3>DS2>DS4. The ratio of DS1 : DS2 : DS3 : DS4 is approximately 200–300:5:20:1, although it depends upon the sum of the stock removals in the four steps. The relation of the rotational speeds may be modified to N2>N3=N1, and the relation of the infeed amounts may be modified to DS1>DS3>DS2=DS4.

It should be understood that in the case where the circumferential speed of each cam Wc relative to the grinding wheel 26 is controlled to be constant, each of the rotational speed N1, N2 and N3 represents its mean value.

In this manner, each cam Wc is successively subjected to the rough grinding, the two step prefinish grindings and the finish grinding, whereupon the wheel head 12 is rapidly retracted. Subsequently, the work table 11 is indexed to bring another cam Wc to be machined next into alignment with the grinding wheel 26, and the grinding wheel 26 is dressed with the dressing tool 41 during such table indexing movement. Upon completion of the table indexing movement, the same grinding cycle as described earlier is performed, whereby said another cam Wc is successively subjected to the rough grinding, the two step prefinish grindings and the finish grinding. Each of the remaining cams Wc is finished by repeating the aforementioned operation after one table indexing movement.

In this preferred embodiment, there are needed dressing operations of the number which is the same as the number of cams Wc on the camshaft W. The number of dressing operations is therefore larger than the number of dressing operations which are performed in the prior art cam grinder for machining one camshaft of the same kind. However, it is to be noted that the increase in dressing operations does not affect the grinding cycle time because each dressing is performed during the indexing movement of the work table 11. In addition, since the damage on the grinding wheel 26 in each grinding cycle is small, the dressing infeed amount in each dressing operation can be set samll, thereby avoiding the shortening of the grinding wheel life.

Figure 4:
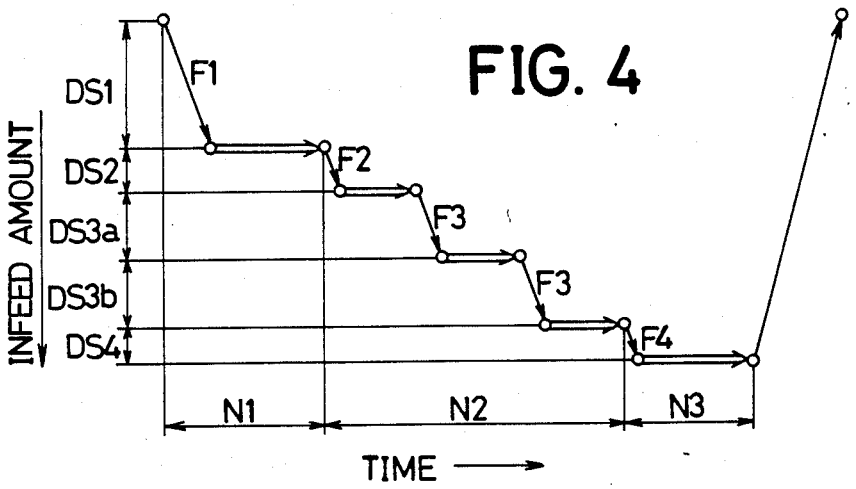
FIG. 4 is a chart showing another grinding cycle constituting a second embodiment of the present invention.
Figure 5:
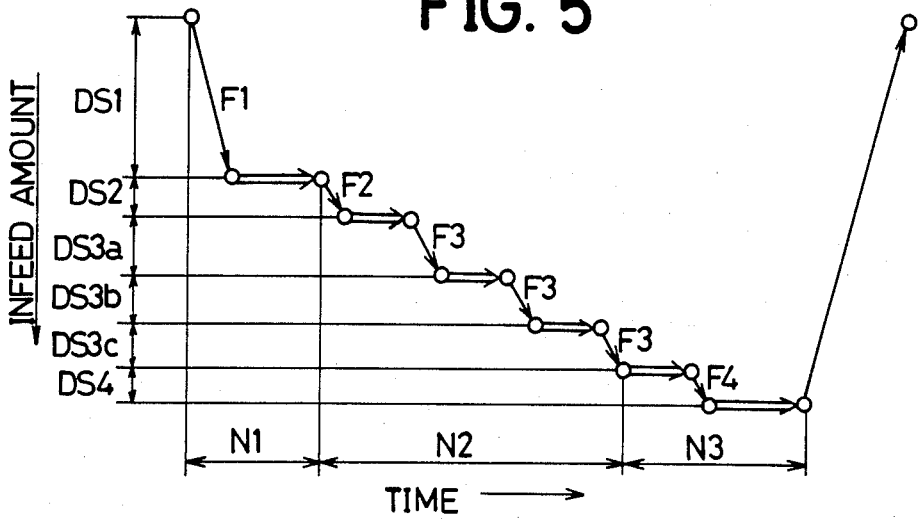
FIG. 5 is a chart showing still another grinding cycle constituting a third embodiment of the present invention.

FIGS. 4 and 5 respectively illustrate grinding cycles in other embodiments according to the present invention. Each of these cycles is performed by the cam grinder where the grinding crack layer created in the first step is deep. In each of these cycles, the third step is divided into two subordinate steps (FIG. 4) or three subordinate steps (FIG. 5). Accordingly, the grinding crack layer can be gradually removed through two or three steps without causing any substantial damage on the grinding wheel 26. In these embodiments, the infeed amount DS3a in the first subordinate step of the third step is chosen to 0.2 mm, while the infeed amounts DS3b and DS3c in the second and third subordinate steps of the third step are chosen to 0.05 mm and 0.01 mm, respectively.

Figure 6:
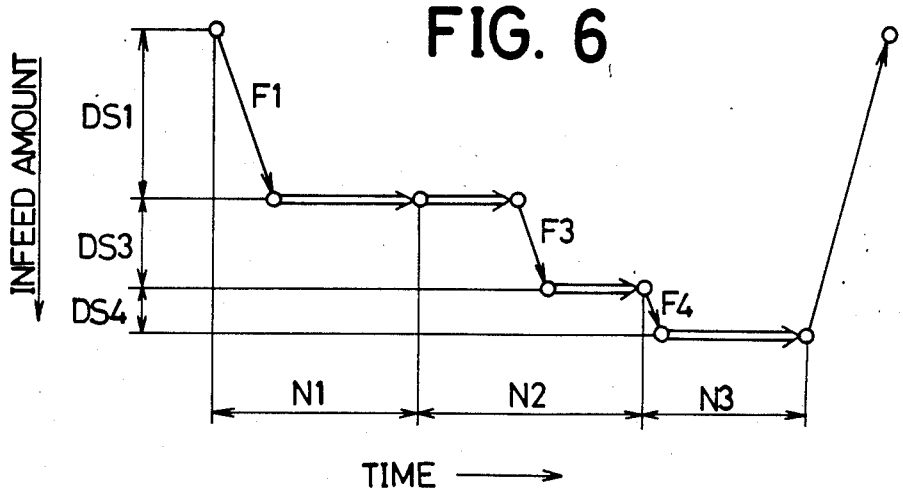
FIG. 6 is a chart showing a further grinding cycle constituting a fourth embodiment of the present invention.

Referring then to FIG. 6, there is illustrated a grinding cycle used in still another embodiment according to the present invention. In this cycle, the infeed amount DS2 of the wheel head 12 in the second step is chosen to 0 (zero), whereby uncut stocks at the side portions of each cam Wc are removed during the spark-out grinding time.

Although in each of the above-described embodiments, the dressing of the grinding wheel 26 is performed during each indexing movement of the work table 11, the present invention is not limited to such a one-cam one-dressing method. Where the damage on the grinding wheel 26 is small after the grinding of one cam, the dressing interval may be extended for one dressing per two cams.

Obviously, numerous modifications and variations of the present invention are possible in light of the above teachings. It is therefore to be understood that within the scope of the appended claims, the present invention may be practiced otherwise than as specifically described herein.

What is claimed is:

1. A method of successively grinding a plurality of cams of a camshaft by axially indexing said camshaft for selectively aligning said cams with a grinding wheel and by subsequently bringing an aligned one of said cams into contact with said grinding wheel while said camshaft is rotated and rocked respectively about its axis and a pivot axis parallel thereto, said method comprising:

a first step of removing the substantial part of a removal amount of said aligned one of said cams by effecting a rough grinding in such a manner that said grinding wheel is infed while said camshaft is rotated at a first slow rotational speed;

after a spark out period, subsequently and without dressing said grinding wheel, performing a second step of removing a part of said removal amount which is to be cut off but left uncut in said first step, from side portions of said aligned one of said cams by rotating said camshaft at a second high rotational speed as compared to said first rotational speed;

after a spark out period, subsequently and without dressing said grinding wheel, performing a third step of removing a thermally affected layer from said aligned one of said cams by infeeding said grinding wheel while said camshaft is rotated at a third high rotational speed as compared to said first rotational speed;

after a spark out period, subsequently and without dressing said grinding wheel, performing a fourth step of effecting a finish grinding by infeeding said grinding wheel while said camshaft is rotated at a fourth slow rotational speed as compared to said second rotational speed; and after a spark out period, a first step of axially indexing said camshaft for bringing another cam of said camshaft into alignment with said grinding wheel so as to subsequently grind said another cam by sequentially performing said first to fourth steps.

2. A method as set forth in claim 1, wherein:

each of said first through fourth steps includes at its final stage a spark-out grinding step of rotating said camshaft at least one rotation without further infeeding said grinding wheel against said aligned one of said cams.

3. A method as set forth in claim 1, wherein:

the rotational speed of said camshaft in each of said first and fourth steps is chosen to be slower than that in each of said second and third steps.

4. A method as set forth in claim 3, wherein:

the rotational speeds of said camshaft in said second and third steps are chosen to be identical with each other; and the rotational speeds N1, N2 and N3 of said camshaft respectively in said first step, said second and third steps and said fourth step have a relation $N2 > N3 \geqq N1$.

5. A method as set forth in claim 3, wherein:

the infeed amounts DS1, DS2, DS3 and DS4 of said grinding wheel respectively in said first through fourth steps have a relation $DS1 > DS3 > DS2 \geqq DS4$.

6. A method as set forth in claim 5, wherein:

said infeed amounts DS1, DS2, DS3 and DS4 which said grinding wheel is moved respectively in said first and fourth steps are respectively 200–300:5:20:1 in ratio.

7. A method as set forth in claim 3, wherein said grinding wheel is infed against said aligned one of said cams at first to fourth infeed rates F1, F2, F3 and F4 respectively in said first through fourth steps, and wherein:

each of said second and third infeed rates F2 and F3 is slower than said first infeed rate F1, but faster than said fourth infeed rate F4.

8. A method as set forth in claim 7, wherein:

said first, second, third and fourth infeed rates F1, F2, F3 and F4 are respectively 3:2:2:1 in ratio.

9. A method as set forth in claim 3, wherein said third step comprises a plurality of subordinate wheel infeed steps.

* * * * *